US012037089B2

(12) United States Patent
Langdon et al.

(10) Patent No.: US 12,037,089 B2
(45) Date of Patent: Jul. 16, 2024

(54) CONTAINER HOPPER BARGE WITH PEDESTAL SUPPORT SYSTEM

(71) Applicant: Arcosa Marine Products, Inc., Dallas, TX (US)

(72) Inventors: Neal E. Langdon, Goodlettsville, TN (US); Bryson Michael Person, Mandeville, LA (US); Kent Joseph Achord, Prairieville, LA (US); Charles Gregory Cox, Covington, LA (US)

(73) Assignee: ARCOSA MARINE PRODUCTS, INC., Dallas, TX (US)

( * ) Notice: Subject to any disclaimer, the term of this patent is extended or adjusted under 35 U.S.C. 154(b) by 168 days.

(21) Appl. No.: 17/486,653

(22) Filed: Sep. 27, 2021

(65) Prior Publication Data

US 2022/0097807 A1 Mar. 31, 2022

Related U.S. Application Data

(60) Provisional application No. 63/084,309, filed on Sep. 28, 2020.

(51) Int. Cl.
*B63B 35/28* (2006.01)
*B63B 3/56* (2006.01)
*B63B 25/00* (2006.01)

(52) U.S. Cl.
CPC ..... *B63B 35/28* (2013.01); *B63B 3/56* (2013.01); *B63B 25/004* (2013.01)

(58) Field of Classification Search
CPC ... B63B 25/02; B63B 25/004; B63B 2025/28; B63B 35/28; B63B 2035/00; B63B 3/20;
(Continued)

(56) References Cited

U.S. PATENT DOCUMENTS 1,063,284 A * 6/1913 Reid ..... B63B 35/306 114/36
5,359,952 A 11/1994 Klundt et al.

FOREIGN PATENT DOCUMENTS

CN 201610215 U 10/2010
DE 2531909 A1 6/1977
(Continued)

OTHER PUBLICATIONS

International Search Report and Written Opinion of PCT Patent Application No. PCT/US2021/052220, mailed Jan. 24, 2021; 124pages.
(Continued)

*Primary Examiner* — Daniel V Venne
(74) *Attorney, Agent, or Firm* — Baker Botts L.L.P.

(57) ABSTRACT

A hopper barge is disclosed. The hopper barge comprises a hopper compartment for carrying a plurality of containers, the hopper compartment comprising a hopper compartment deck. The hopper barge comprises an inner-bottom portion defined in part by the hopper compartment deck and a bottom portion of the hopper barge. A plurality of longitudinal bulkheads are arranged in parallel within the inner-bottom portion of the hopper barge. A plurality of transverse bulkheads are arranged in parallel within the inner-bottom portion of the hopper barge, the plurality of transverse bulkheads running perpendicular to the plurality of longitudinal bulkheads. A plurality of pedestal supports are affixed to the hopper compartment deck, wherein at least one of the plurality of longitudinal bulkheads intersects at least one of the plurality of transverse bulkheads at a position beneath at least one of the plurality of pedestal supports.

10 Claims, 9 Drawing Sheets

(58) Field of Classification Search
CPC .... B63B 3/52; B63B 3/56; B63B 3/62; B63B 3/70
USPC ..... 114/65, 72, 73, 78, 79, 88
See application file for complete search history.

(56) References Cited

FOREIGN PATENT DOCUMENTS

| | | | |
|---|---|---|---|
| EP | 0562145 | A1 | 9/1993 |
| GB | 1163987 | A | 9/1969 |
| SU | 648463 | A1 | 2/1979 |
| WO | 9958333 | A1 | 11/1999 |
| WO | 2012081365 | A1 | 6/2012 |
| WO | 2017033372 | A1 | 3/2017 |

OTHER PUBLICATIONS

International Preliminary Report on Patentability corresponding to International Application No. PCT/US2021/052220, dated Mar. 28, 2023, 8 pages.

* cited by examiner

CONTAINER HOPPER BARGE WITH PEDESTAL SUPPORT SYSTEM

PRIORITY

This nonprovisional application claims priority to U.S. Provisional Patent Application No. 63/084,309, entitled "CONTAINER HOPPER BARGE WITH PEDESTAL SUPPORT SYSTEM" filed on Sep. 28, 2020 which is hereby incorporated by reference in its entirety.

TECHNICAL FIELD

The present disclosure relates, in general, to marine transport and, more particularly, to an improved hopper barge design and pedestal support system for transporting containers or other large cargo via barge.

BACKGROUND

Hopper barges are often used to transport coal, various types of granular materials, or other chemical and industrial cargoes. There is an increasing interest in transporting other goods by loading commercial shipping containers on hopper barges, thereby expanding the utility of barge fleets. According to one existing approach, containers are put on a standard-size hopper barge that is 35' wide and 200' long that has had minor modifications to hold containers. Such an approach is described in more detail below in relation to FIG. 1.

FIG. 1 illustrates an example of an existing approach to container-on-barge transport. More particularly, FIG. 1 illustrates an end-view 100 of a first barge 102 and a second barge 104 positioned adjacent one another (e.g., as may be the case when first barge 102 and second barge 104 are located in a river lock). As can be seen from FIG. 1, first barge 102 and second barge 104 are substantially similar in design. First barge 102 and second barge 104 are both examples of the standard 35' wide by 200' long hopper barges in use today. First barge 102 has a hopper compartment 106 located between barge wings 110*a* and 110*b* disposed on opposite sides of first barge 102. Similarly, second barge 104 has a hopper compartment 108 located between barge wings 112*a* and 112*b* disposed on opposite sides of second barge 104.

In the example of FIG. 1, first barge 102 and second barge 104 are each loaded with a respective plurality of containers 114, 116. Containers 114 loaded on first barge 102 are set upon a plurality of supports 118. Similarly, containers 116 loaded on second barge 104 are set upon a plurality of supports 120. Supports 118, 120 are examples of conventional container supports, which are typically formed from steel beams or, in some cases, square log timbers. Supports 118 sit upon hopper compartment deck 122 of first barge 102. Supports 120 sit upon hopper compartment deck 124 of second barge 104. Typically, there is a space of approximately 15 inches between hopper compartment decks 122, 124 and bottom portions 126, 128 of first barge 102 and second barge 104, respectively. Within the void space between hopper compartment decks 122, 124 and bottom portions 126, 128 (which may be referred to herein as the "inner-bottom portion" of a barge) are typically found a plurality of transverse bulkheads that provide support for hopper compartments 106, 108, respectively.

At present, container-on-barge movement is minimal on U.S. rivers, despite the cost and fuel efficiency advantages of barges. In the last two years, however, approximately $100 million has been invested in port infrastructure. With this investment in port infrastructure, it is possible that container-on-barge movement in the U.S. may increase in the future.

When used for transporting containers, existing hopper barge designs suffer from a number of deficiencies. For instance, the structure of existing hopper barges limits the number of containers that can be safely transported on the barges. Traditional hopper barges in service today (e.g., hopper barges 102, 104 described above) have a bottom designed for a universally spread out load over the bottom (e.g., grain or coal that fills up the hopper area). In transport, however, containers 114, 116 do not sit flat on hopper compartment decks 122, 124. Rather, each of containers 114, 116 sits on four points (points located at each corner of containers 114, 116). As a result, containers 114, 116 generate a huge point load that must be effectively dispersed so as to not cause a failure in the bottom of the hopper and/or the barge. Existing designs rely solely on transverse supports in the inner-bottom portion and conventional container supports. As a result, existing hopper barges can only support a limited number of containers. Indeed, with the typical hopper barge designs illustrated in FIG. 1, each 35' wide barge 102, 104 can safely carry a maximum of three rows of containers 114, 116 stacked three containers high (although the number of total containers may vary depending on the dimensions of containers 114, 116). This is a disadvantage, as it limits the total amount of lading that may be carried by hopper barges 102, 104.

There have been attempts to design a container support that can effectively distribute the point load from containers on a standard 35' barge. These efforts have been largely unsuccessful, however, as the resulting designs are large, bulky structures and, in any event, the existing barge still could not support the required load. Accordingly, there is a need for improved hopper barge and container support designs that enhance the utility and usage of barges.

SUMMARY

To address the foregoing problems with existing solutions, disclosed is a hopper barge. The hopper barge comprises a hopper compartment for carrying a plurality of containers, the hopper compartment comprising a hopper compartment deck. The hopper barge comprises an inner-bottom portion defined in part by the hopper compartment deck and a bottom portion of the hopper barge. The hopper barge comprises a plurality of longitudinal bulkheads arranged in parallel within the inner-bottom portion of the hopper barge. The hopper barge comprises a plurality of transverse bulkheads arranged in parallel within the inner-bottom portion of the hopper barge, the plurality of transverse bulkheads running perpendicular to the plurality of longitudinal bulkheads. The hopper barge comprises a plurality of pedestal supports affixed to the hopper compartment deck, where at least one of the plurality of longitudinal bulkheads intersects at least one of the plurality of transverse bulkheads at a position beneath at least one of the plurality of pedestal supports.

In certain embodiments, the hopper barge may be approximately 70 feet wide.

In certain embodiments, the at least one of the plurality of pedestal supports may comprise an outer pipe and a plurality of rib plates affixed to the outer pipe. In certain embodiments, the at least one of the plurality of pedestal supports may further comprise an inner pipe disposed within the outer pipe. In certain embodiments, the plurality of rib plates may be affixed to the inner pipe. In certain embodiments, the at least one of the plurality of pedestal supports may comprise a top plate. In certain embodiments, the at least one of the plurality of pedestal supports may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

Also disclosed is a hopper barge. The hopper barge comprises an inner-bottom portion having arranged therein a plurality of longitudinal bulkheads and a plurality of transverse bulkheads, the transverse bulkheads running perpendicular to the longitudinal bulkheads.

In certain embodiments, the hopper barge may be approximately 70 feet wide.

Also disclosed is a pedestal support. In certain embodiments, the pedestal support may comprise an outer pipe and a plurality of rib plates affixed to the outer pipe. In certain embodiments, the pedestal support may further comprise an inner pipe disposed within the outer pipe. In certain embodiments, the plurality of rib plates may be affixed to the inner pipe.

In certain embodiments, the pedestal support may comprise a top plate. In certain embodiments, the pedestal support may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

Also disclosed is a hopper barge. The hopper barge comprises: at least one longitudinal bulkhead; at least one transverse bulkhead; and at least one pedestal support. The at least one longitudinal bulkhead and the at least one transverse bulkhead intersect at a position beneath the at least one pedestal support.

In certain embodiments, the hopper barge may be approximately 70 feet wide.

In certain embodiments, the at least one pedestal support may comprise: an outer pipe and a plurality of rib plates affixed to the outer pipe. In certain embodiments, the at least one pedestal support may further comprise an inner pipe disposed within the outer pipe. In certain embodiments, the plurality of rib plates may be affixed to the inner pipe.

In certain embodiments, the at least one pedestal support may comprise a top plate. In certain embodiments, the at least one pedestal support may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

Certain embodiments of the present disclosure may provide one or more technical advantages. As one example, the new hopper barge design described herein may advantageously provide support for the point loads generated by the containers, as the four corners of the container is what supports the load. This may be achieved through the use of longitudinal bulkheads and improved pedestal supports that the container corners sit on. The pedestal supports are advantageously designed to transfer the point load into the bottom of the barge. As another example, the hopper barge design described herein may advantageously permit containers to be loaded four high. As still another example, the new pedestal supports described herein may advantageously keep the containers above the floor of the hopper so they will remain dry from rain water. Other advantages may be readily apparent to one having skill in the art. Certain embodiments may have none, some, or all of the recited advantages.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
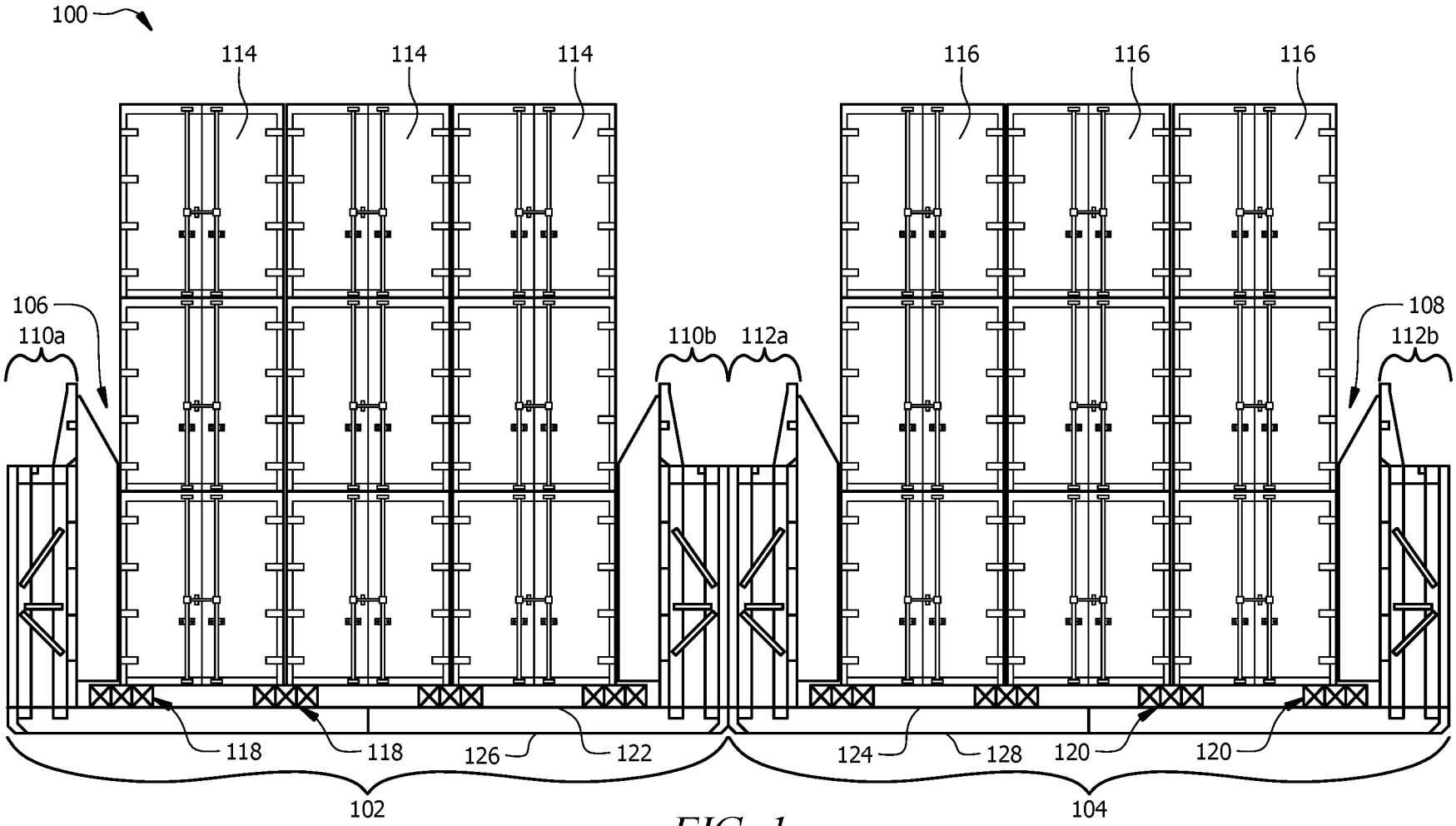
FIG. 1 illustrates an example of an existing approach to container-on-barge transport.

As described above, when used for transporting shipping containers, existing hopper barge designs suffer from certain deficiencies. For instance, traditional hopper barges have an inner-bottom portion designed for a universally spread out load (e.g., grain or coal that fills up the hopper area). In transport, however, containers do not sit flat on hopper compartment decks. Rather, each of the containers sits on four points. As a result, the containers generate a huge point load that must be effectively dispersed so as to not cause a failure in the bottom of the hopper and/or the barge. The structure of existing hopper barges, which use only transverse supports in the inner-bottom portion of the barge and conventional container supports, can only support a limited number of containers. This constrains the total amount of lading that may be carried by existing hopper barges.

The present disclosure contemplates various embodiments that may address these and other deficiencies associated with existing hopper barges and container supports. In certain embodiments, this is achieved through the use of a wider hopper barge (e.g., 70' wide) that has an improved inner-bottom structure and novel pedestal supports. The design of the wider barge, along with the way the barge can support the weight of the stacked containers, are particularly advantageous aspects of the present disclosure. As described in more detail herein, longitudinal and transverse bulkheads in the hopper inner-bottom portion are configured to support the additional point loads from the container corners. Improved pedestal supports, which the container corners sit on during transport, are also used to transfer the point load from the containers into the bottom of the barge. The inner-bottom re-design and the resulting support structure in the hopper and the underside of the hopper provide additional strength, making it possible to load the barge with a larger number of containers than was previously possible. Moreover, making the barge wider (e.g., 70' wide versus the typical 35' wide barge) advantageously allows more containers (e.g., in some implementations an extra row of containers and an extra layer of containers) due to the additional space available and the added stability of the barge.

Another advantageous aspect of the new hopper barge design described herein is that the wider barge still works on U.S. river systems. Locks and dams on major waterways in the U.S. (e.g., the Mississippi River and the Ohio River) are typically 110' wide and 1,000' long (enough to fit five rows of three standard 35' wide by 200' long hopper barges). The wider hopper barge design described herein takes up the same space as two standard 35' wide barges, making it functional on the U.S. inland river system.

Several embodiments are elaborated in this disclosure. According to one example embodiment, a hopper barge is disclosed. The hopper barge comprises a hopper compartment for carrying a plurality of containers, the hopper compartment comprising a hopper compartment deck. The hopper barge comprises an inner-bottom portion defined in part by the hopper compartment deck and a bottom portion of the hopper barge. The hopper barge comprises a plurality of longitudinal bulkheads arranged in parallel within the inner-bottom portion of the hopper barge. The hopper barge comprises a plurality of transverse bulkheads arranged in parallel within the inner-bottom portion of the hopper barge, the plurality of transverse bulkheads running perpendicular to the plurality of longitudinal bulkheads. The hopper barge comprises a plurality of pedestal supports affixed to the hopper compartment deck, wherein at least one of the plurality of longitudinal bulkheads intersects at least one of the plurality of transverse bulkheads at a position beneath at least one of the plurality of pedestal supports.

In certain embodiments, the hopper barge may be approximately 70 feet wide.

In certain embodiments, the at least one of the plurality of pedestal supports may comprise an outer pipe and a plurality of rib plates affixed to the outer pipe. In certain embodiments, the at least one of the plurality of pedestal supports may further comprise an inner pipe disposed within the outer pipe. In certain embodiments, the plurality of rib plates may be affixed to the inner pipe. In certain embodiments, the at least one of the plurality of pedestal supports may comprise a top plate. In certain embodiments, the at least one of the plurality of pedestal supports may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

According to another example embodiment, a hopper barge is disclosed. The hopper barge comprises an inner-bottom portion having arranged therein a plurality of longitudinal bulkheads and a plurality of transverse bulkheads, the transverse bulkheads running perpendicular to the longitudinal bulkheads. In certain embodiments, the hopper barge may be approximately 70 feet wide.

According to another example embodiment, a pedestal support is disclosed. The pedestal support may comprise an outer pipe and a plurality of rib plates affixed to the outer pipe. In certain embodiments, the pedestal support may further comprise an inner pipe disposed within the outer pipe; and the plurality of rib plates may be affixed to the inner pipe. In certain embodiments, the pedestal support may comprise a top plate. In certain embodiments, the pedestal support may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

According to another example embodiment, a hopper barge is disclosed. The hopper barge comprises: at least one longitudinal bulkhead; at least one transverse bulkhead; and at least one pedestal support. The at least one longitudinal bulkhead and the at least one transverse bulkhead intersect at a position beneath the at least one pedestal support. In certain embodiments, the hopper barge may be approximately 70 feet wide.

In certain embodiments, the at least one pedestal support may comprise: an outer pipe and a plurality of rib plates affixed to the outer pipe. In certain embodiments, the least one pedestal support may further comprise an inner pipe disposed within the outer pipe. In certain embodiments, the plurality of rib plates may be affixed to the inner pipe. In certain embodiments, the at least one pedestal support may comprise a top plate. In certain embodiments, the at least one pedestal support may comprise a bottom plate. In certain embodiments, the plurality of rib plates may be affixed to the outer pipe by welding. In certain embodiments, the plurality of rib plates may be affixed to the inner pipe by welding. In certain embodiments, the outer pipe may have a diameter of approximately 30 inches. In certain embodiments, the outer pipe is cylinder-shaped. In certain embodiments, the outer pipe is half cylinder-shaped. In certain embodiments, the outer pipe is quarter cylinder-shaped. In certain embodiments, the inner pipe may have a diameter of approximately 16 inches.

Certain embodiments may provide one or more technical advantages. As one example, the new hopper barge design described herein may advantageously provide support for the point loads generated by the containers, as the four corners of the container is what supports the load. This may be achieved through the use of longitudinal and transverse bulkheads in the inner-bottom portion of the hopper barge and improved pedestal supports that the container corners sit on. The pedestal supports are advantageously designed to transfer the point load into the bottom of the barge. As another example, the hopper barge design described herein permits containers to be loaded four high. As still another example, the new pedestal supports described herein may advantageously keep the containers above the floor of the hopper so they will remain dry from rain water. Other objects, features, and advantages of the present disclosure will be apparent to persons of ordinary skill in the art in view of the following detailed description of the disclosure and the accompanying drawings. Certain embodiments may have none, some, or all of the recited advantages.

Some of the embodiments contemplated by the present disclosure will now be described more fully with reference to the accompanying drawings. Other embodiments, however, are contained within the scope of the subject matter disclosed herein. The disclosed subject matter should not be construed as limited to only the example embodiments set forth herein; rather, these embodiments are provided by way of example to convey the scope of the subject matter to those skilled in the art.

Figure 2:
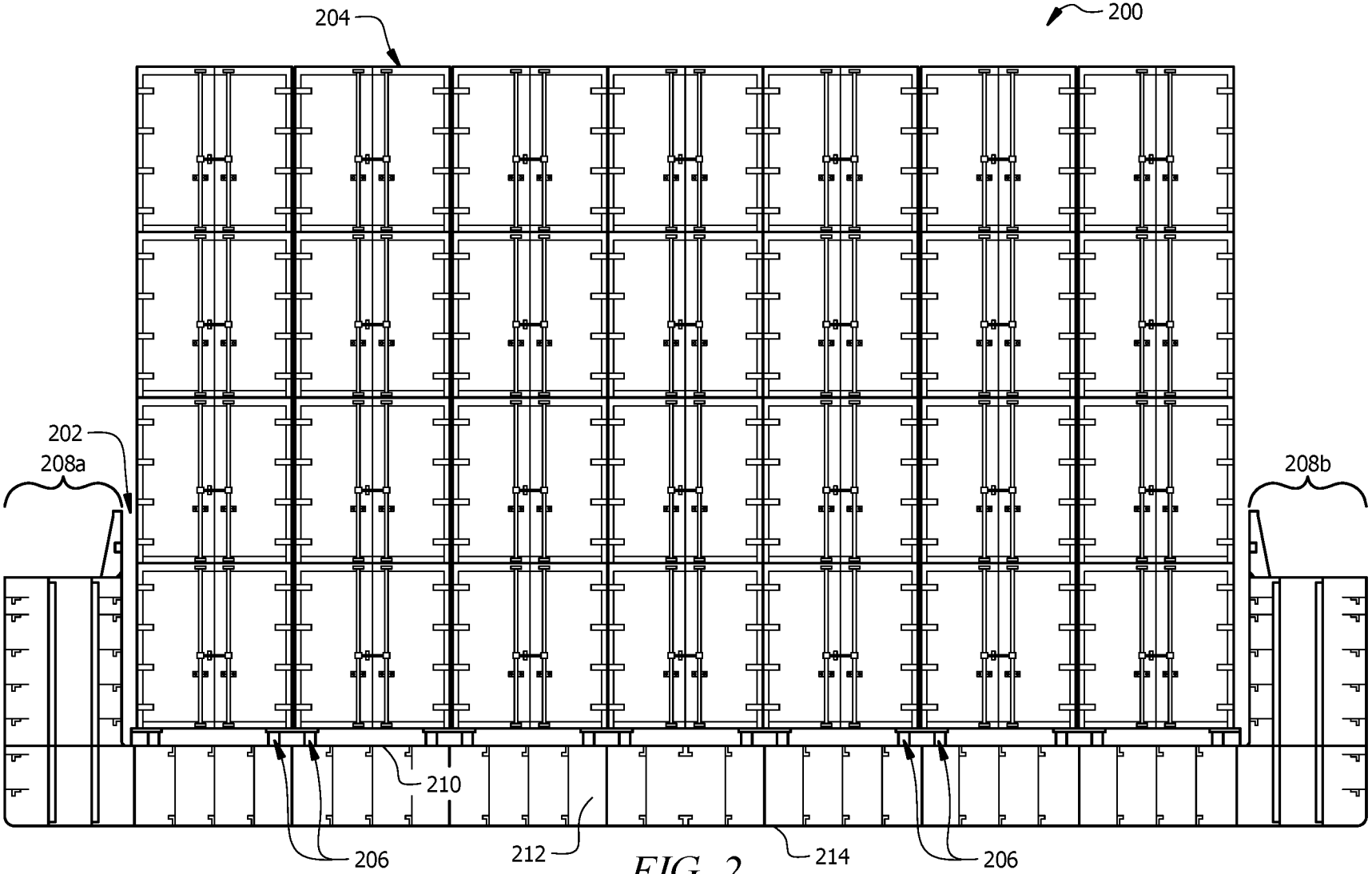
FIG. 2 illustrates an example of a hopper barge for container-on-barge transport, in accordance with certain embodiments.

FIG. 2 illustrates an example of a hopper barge for container-on-barge transport, in accordance with certain embodiments. More particularly, FIG. 2 illustrates an end view of an improved hopper barge 200 having an increased width as compared to existing hopper barges. Hopper barge 200 has a hopper compartment 202 positioned between barge wings 208*a* and 208*b* disposed on opposite sides of hopper barge 200. In the example embodiment of FIG. 2, hopper compartment 202 is loaded with a plurality of containers 204. Corners of containers 204 sit on a plurality of pedestal supports 206. Pedestal supports 206 sit upon hopper compartment deck 210. Inner-bottom portion 212 is located between hopper compartment deck 210 and bottom portion 214 of hopper barge 200. Inner-bottom portion 212 is a space defined at least in part by hopper compartment deck 210 and bottom portion 214 of hopper barge 200. As described in more detail below in relation to FIG. 5, longitudinal and transverse bulkheads are arranged within inner-bottom portion 212 so as to provide support for hopper compartment 202 and, in combination with pedestal supports 206, effectively disperse the point loads generated by containers 204. More particularly, the longitudinal and transverse bulkheads in inner-bottom portion 212 may be flat plates (e.g., steel plates) positioned vertically within inner-bottom portion 212. The longitudinal and transverse bulkheads may be affixed to bottom portion 214 and an underside of hopper compartment deck 210 (e.g., by welding). The transverse and longitudinal bulkheads intersect at positions beneath each pedestal support 206. These aspects of the design of inner-bottom portion 212 are substantially different from existing hopper barges, which typically include only transverse bulkheads. Unlike existing hopper barges, the structure of inner-bottom portion 212, used in combination with pedestal supports 206, can effectively support the point loads from containers 204 and transfer the point loads from containers 204 into bottom 214 of hopper barge 200.

Exemplary dimensions for the example embodiment of hopper barge 200 illustrated in FIG. 2 will now be described. It should be understood, however, that the following dimensions are for purposes of example only. The present disclosure is not limited to the exemplary dimensions described herein. In the example embodiment of FIG. 2, hopper barge 200 has a length of 200' and a width of 70' (twice the width of a typical hopper barge, such as the 35' wide hopper barges 102, 104 described above in relation to FIG. 1). While a typical hopper barge has an inner-bottom portion that is approximately fifteen inches deep, inner-bottom portion 212 of hopper barge 200 in the example embodiment of FIG. 2 is 4'6". This additional space in inner-bottom portion 212 allows for larger transverse and longitudinal bulkheads to be used, which provides increased structural support for hopper barge 200. Additionally, in the example embodiment of FIG. 2, barge wings 208*a*, 208*b* of hopper barge 200 are 6' wide (as compared to the typical 3'6" design of typical hopper barges). As described in more detail below, the dimensions of wings 208 in this example embodiment are designed to maximize the size of hopper compartment 202.

The exemplary dimensions of hopper barge 200 in FIG. 2 may confer certain advantages over existing hopper barge designs. For instance, a width of 70' makes hopper barge 200 more stable in the water and therefore less likely to tip over. Wider barge wings 208*a*, 208*b* help increase the strength of hopper barge 200 (as compared to existing designs). Additionally, hopper barge 200, being 70' wide, has a width equal to that of two standard 35 foot barges. As a result, hopper barge 200 can be used with existing port infrastructure (locks and dams on U.S. waterways are generally 110' wide, with enough space for three standard-size 35' barges).

Notably, the wider design of hopper barge 200 also allows for hopper barge 200 to carry more cargo (e.g., more containers) than it would be possible to transport with two standard-size 35' barges. This can be seen from a comparison of the wider, 70' barge design depicted in FIG. 2 with the example of two standard-size 35' barges in FIG. 1. As can be seen, hopper barge 200 can carry seven rows of containers stacked four high versus six rows of containers stacked three high in the case of two traditional barges. The wider design of hopper barge 200 allows for the extra row of containers (e.g., in space that would otherwise have been taken up by barge wings if two standard-size 35' barges were used). Additionally, hopper barge 200 can carry an extra level of containers (i.e., containers stacked four high) as compared to the traditional barge design, which can only carry containers stacked three high. The ability to carry an extra level of containers is a result of the new design of inner-bottom portion 212 and the use of pedestal supports 206, which together allow for the point loads of containers 204 to be effectively dispersed.

Figure 3:
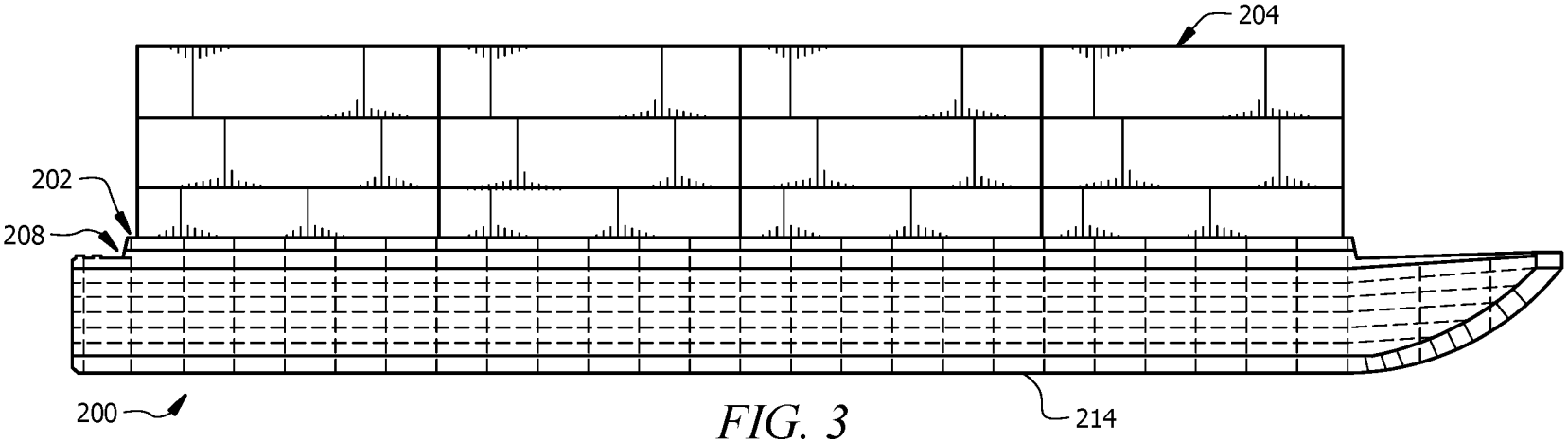
FIG. 3 illustrates an outboard profile of a hopper barge for carrying shipping containers, in accordance with certain embodiments.

FIG. 3 illustrates an outboard profile of a hopper barge for carrying shipping containers, in accordance with certain embodiments. More particularly, FIG. 3 illustrates an outboard profile of hopper barge 200 depicted in FIG. 2. Similar to FIG. 2 above, hopper barge 200 includes containers 204 stacked four high in hopper compartment 202. Containers 204 are partially obscured from view by barge wing 208. In the example embodiment of FIG. 3, hopper barge 200 is approximately 200' long.

Figure 4:
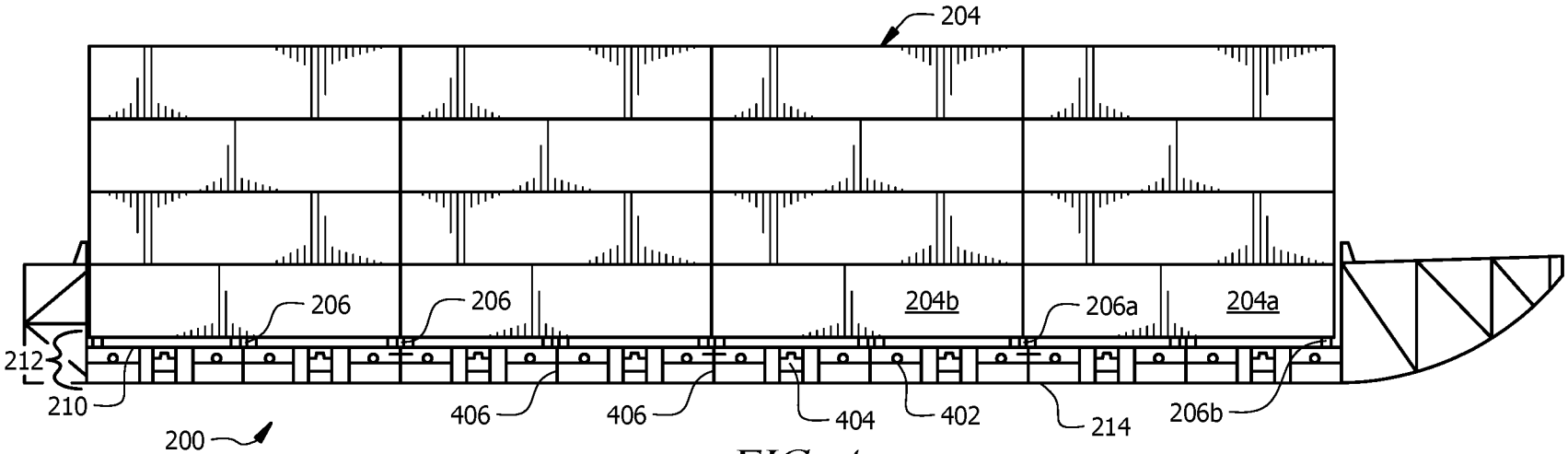
FIG. 4 illustrates an inboard profile of a hopper barge for carrying shipping containers, in accordance with certain embodiments.

FIG. 4 illustrates an inboard profile of a hopper barge for carrying shipping containers, in accordance with certain embodiments. More particularly, FIG. 4 illustrates a longitudinal section view of hopper barge 200. FIG. 4 illustrates a plurality of containers 204 set on pedestal supports 206 on hopper compartment deck 210. Pedestal supports 206 may be designed to support up to four corners of containers 204 (e.g., one corner each of four different containers 204). In the example embodiment of FIG. 4, each pedestal support 206 supports at least one corner of a container 204. For instance, pedestal support 206*a* supports one corner of container 204*a* and one corner of container 204*b*. Pedestal support 206*b*, meanwhile, supports a different corner of container 204*a*. The structure of pedestal supports 206, which help to distribute the point loads from containers 204, is described in more detail below in relation to FIGS. 8 and 9.

FIG. 4 also illustrates, in part, the design of inner-bottom portion 212 of hopper barge 200. As shown in FIG. 4, inner bottom portion 212 of hopper barge 200 includes a longitudinal bulkhead 402 (which may also be referred to herein as a keelson) that runs substantially longitudinally under hopper compartment deck 210 from one end of hopper compartment 212 to the other. Inner bottom portion 212 also includes a plurality of transverse bulkheads 406 that run substantially perpendicular to longitudinal bulkhead 402. As can be seen in FIG. 4, transverse bulkheads 406 intersect longitudinal bulk head 402 at positions located underneath each pedestal support 206.

In the example embodiment of FIG. 4, longitudinal bulkhead 402 includes a plurality of holes 404 arranged substantially evenly along its length. Holes 404 allow water to pass through longitudinal bulkhead 402 (e.g., in the event of a hull breach). As described in more detail below in relation to FIGS. 6 and 7, some of the longitudinal bulkheads 402 in inner-bottom portion 212 do not have holes 404. Longitudinal bulkheads 402 that lack holes may define, in part, water-tight areas of inner-bottom portion 212.

Figure 5:
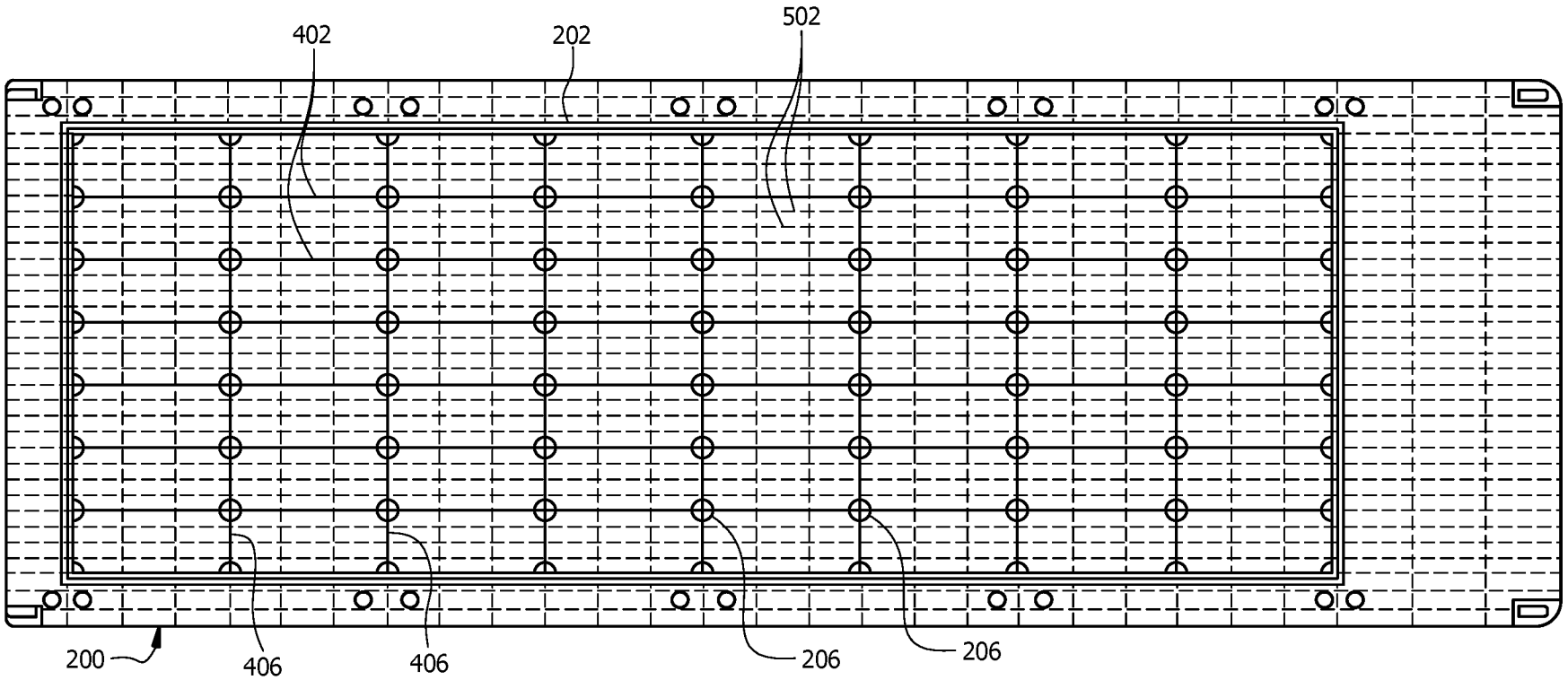
FIG. 5 illustrates a plan view of a hopper barge for carrying shipping containers, in accordance with certain embodiments.

FIG. 5 illustrates a plan view of a hopper barge for carrying shipping containers, in accordance with certain embodiments. More particularly, FIG. 5 illustrates a top-down view of hopper barge 200. A boundary of hopper compartment 202 is shown by a set of double lines outlining a substantially rectangular shape. Placement of pedestal supports 206 is indicated using a plurality of circles.

In FIG. 5, a plurality of longitudinal bulkheads 402 run substantially longitudinally from one end of hopper compartment 202 to the other. As can be seen, longitudinal bulkheads 402 run substantially parallel to one another. A plurality of transverse bulkheads 406 are shown running perpendicular to longitudinal bulkheads 402. Transverse bulkheads 406 intersect longitudinal bulkheads 402 underneath each pedestal support 206. Longitudinal and transverse bulkheads 402, 406 may be flat plates (e.g., steel plates) positioned vertically within inner-bottom portion 212 of hopper barge 200. Longitudinal and transverse bulkheads 402, 406 may be affixed to bottom portion 214 and an underside of hopper compartment deck 210 (e.g., by welding).

Additionally, a plurality of angles 502 (e.g., 5-inch by 3-inch angles) are shown in FIG. 5 by dashed lines running longitudinally. Angles 502 may be positioned on the underside of hopper compartment deck 210 described above in relation to FIGS. 2 and 4.

The example configuration shown in FIG. 5 is designed to accommodate 40' or 20' long containers by spacing pedestal supports 206 20' apart longitudinally.

Figure 6:
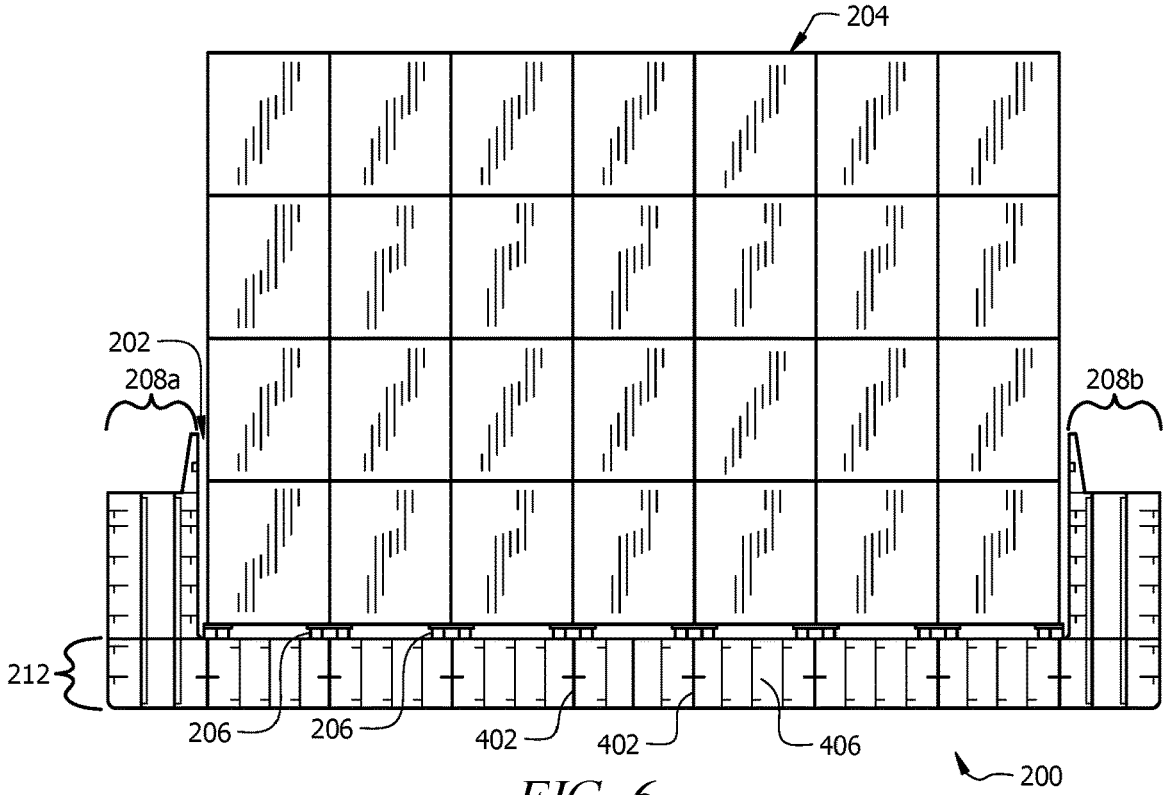
FIG. 6 illustrates a transverse section view of a water-tight portion of a hopper barge for carrying shipping containers, in accordance with certain embodiments.

FIG. 6 illustrates a transverse section view of a water-tight portion of a hopper barge for carrying shipping containers, in accordance with certain embodiments. In the example embodiment of FIG. 6, hopper barge 200 is shown with hopper compartment 202 loaded with containers 204. As discussed above, the increased width of hopper barge 200 (e.g., 70' wide) allows hopper barge 200 to carry a larger number of containers than standard-size 35' hopper barges, in this case seven rows of containers stacked four high.

As described above, inner-bottom portion 212 includes a plurality of longitudinal bulkheads 402 and transverse bulkheads 406. In the example of FIG. 6, a single transverse bulkhead 406 is shown intersected by a plurality of longitudinal bulkheads 402. Longitudinal bulkheads 402 intersect transverse bulkhead 406 underneath each pedestal support 206. Because FIG. 6 illustrates a boundary of a water-tight section of hopper barge 200, transverse bulkhead 406 does not have holes to allow for flow of water.

Figure 7:
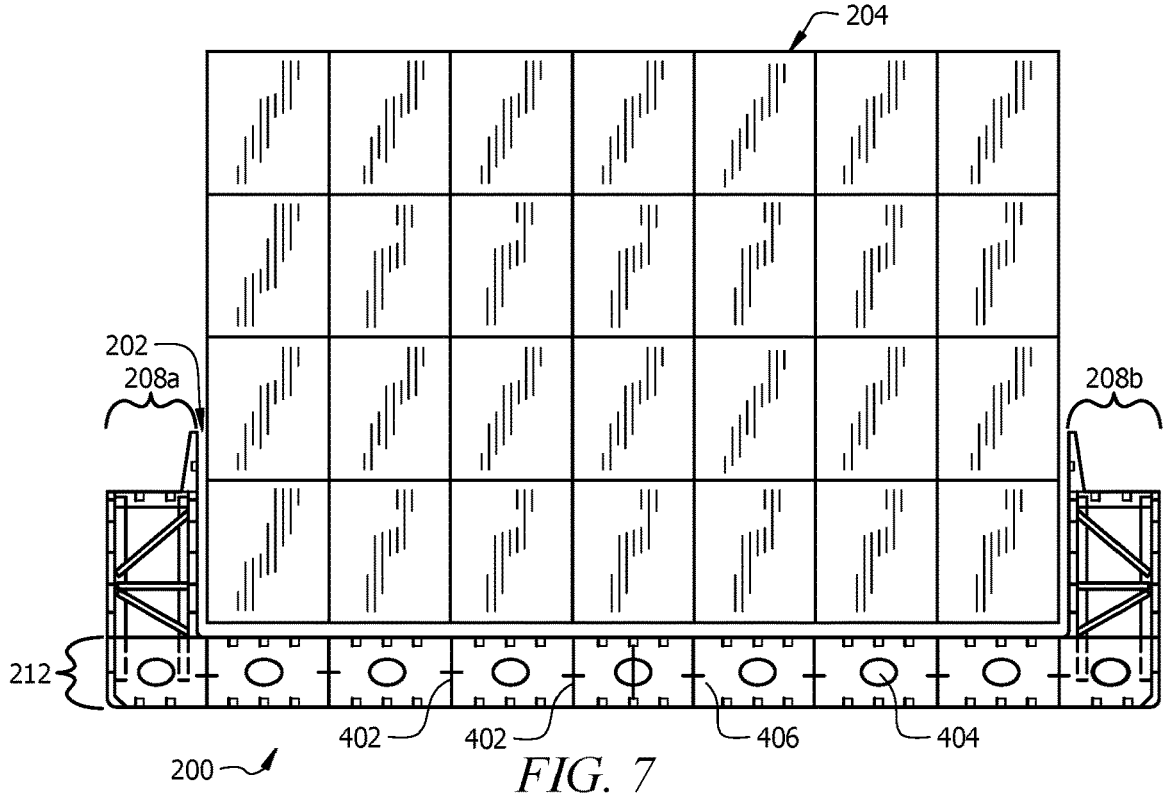
FIG. 7 illustrates a transverse section view of a non-water-tight portion of a hopper barge for carrying shipping containers, in accordance with certain embodiments.

FIG. 7 illustrates a transverse section view of a non-water-tight portion of a hopper barge for carrying shipping containers, in accordance with certain embodiments. FIG. 7 is similar to FIG. 6 in that it illustrates the arrangement of longitudinal bulkheads 402 and transverse bulkhead 406 in inner-bottom portion 212 of hopper barge 200. In contrast to FIG. 6, however, FIG. 7 illustrates a non-water-tight portion of hopper barge 200. Accordingly, transverse bulkhead 406 is shown as having a plurality of holes 404. Similar to holes 404 in longitudinal bulkhead 402 described above in relation to FIG. 4, holes 404 in transverse bulkhead 406 allow water to pass through longitudinal bulkhead 402 (e.g., in the event of a hull breach).

Figure 8:
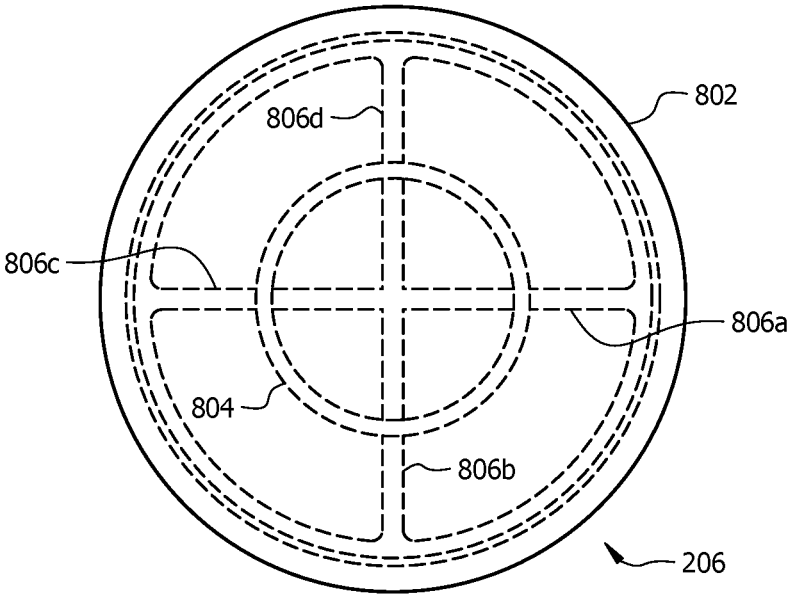
FIG. 8 illustrates a top-view of an example pedestal support, in accordance with certain embodiments.

FIG. 8 illustrates a top view of an example pedestal support, in accordance with certain embodiments. In the example embodiment of FIG. 8, pedestal support 206 is formed from an outer pipe 802 and an inner pipe 804. Outer pipe 802 and inner pipe 804 may be formed from steel or other suitable material. A plurality of ribs 806 are welded to outer pipe 802 and inner pipe 804 to provide additional structural support for pedestal support 206. Ribs 806 may be plates (e.g., steel plates) welded in between the pipes to give it additional support. In certain embodiments, ribs 806 may be ¾" thick flat bar plates. Ribs 806 may cross inside a portion of inner pipe 804 and run from inner pipe 804 to outer pipe 802. In certain embodiments, outer pipe 802 and inner pipe 804 may be hollow (except for rib plates 806).

In the example embodiment of FIG. 8, four ribs 806*a*, 806*b*, 806*c*, and 806*d* are used, effectively dividing pedestal support 206 into four quadrants. Ribs 804*a-d* may be spaced apart evenly such that rib 806*d* is located at the 12 o'clock position, rib 804*a* is located at the 3 o'clock position, rib 806*b* is located at the 6 o'clock position, and rib 806*c* is located at the 9 o'clock position. When used in the context of the improved hopper barge design described herein, each quadrant may advantageously serve to support one corner of a container 204. Typically, a corner of a container is approximately a 7" square.

Outer pipe 802 and inner pipe 804 may have any suitable dimensions, which may vary according to implementation. In certain embodiments, outer pipe 802 may have a diameter between 24-36". In certain embodiments, inner pipe 804 may have a diameter between 12-16". In certain embodiments, outer pipe 802 may have any suitable thickness, such as, between 2" to 5". In certain embodiments, inner pipe 804 may have any suitable thickness, such as, between 2" to 5".

The configuration of outer pipe 802, inner pipe 804, and ribs 806 provides for effective point load distribution. Additionally, the design allows for some flexibility in the placement of containers (which could vary by a couple of inches depending on how carefully the containers are placed). Notably, the design of pedestal supports 206 is especially adapted for use in the improved hopper barge design described herein. In other words, pedestal supports 206 would not work on a standard hopper barge (e.g., 35' hopper barges 102, 104 described above in relation to FIG. 1). If pedestal supports 206 were used on a standard river hopper barge with a 15" inner-bottom portion, the barge would still not be able to support a load of containers stacked four high without the bottom of the barge crumbling. When used in combination with the improved inner-bottom design for a hopper barge described herein, however, the point loads from the containers are effectively distributed.

Figure 9:
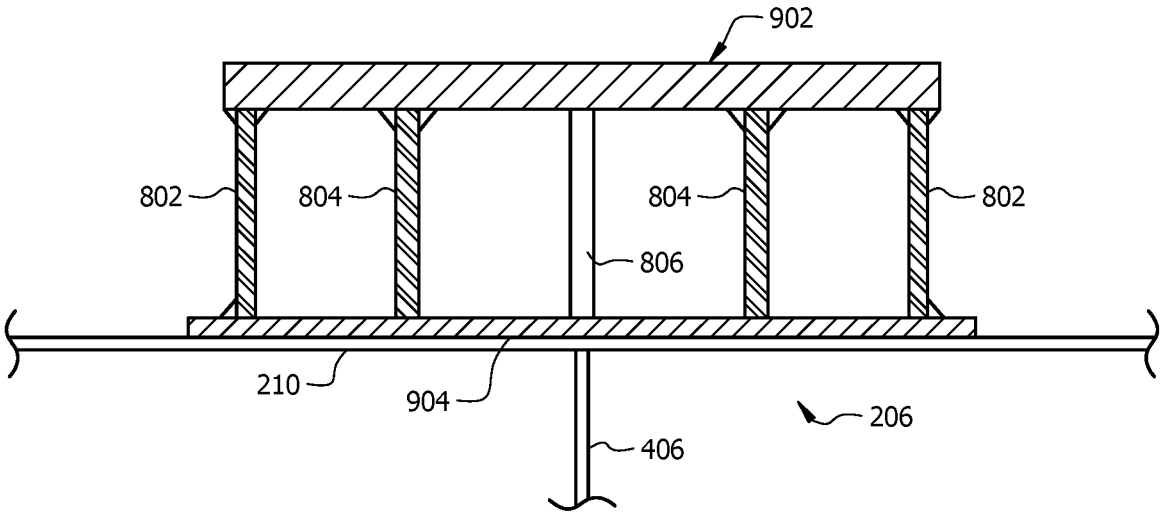
FIG. 9 illustrates a section-view of an example pedestal support, in accordance with certain embodiments.

FIG. 9 illustrates a section-view of an example pedestal support, in accordance with certain embodiments. Similar to FIG. 8 above, pedestal support 206 is formed from outer pipe 802, inner pipe 804, and a rib 806. Outer pipe 802, inner pipe 804, and rib 806 may have the dimensions described above in relation to FIG. 8. Additionally, in the example embodiment of FIG. 9 pedestal support 206 includes top plate 902. Top plate 902 provides a surface on which corners of containers 204 (not explicitly shown) may rest. Top plate 902 may be formed from steel or other suitable material and may have a dimension that corresponds to the diameter of outer pipe 802. In certain embodiments, top plate 902 may be 1½" thick. In certain embodiments, top plate 902 may be welded to outer pipe 802 and inner pipe 804. In the example embodiment of FIG. 9, pedestal support 206 is shown resting on a bottom plate 904, which sits upon hopper compartment deck 210. In certain embodiments, bottom plate 904 may be welded to outer pipe 802.

As described above, longitudinal bulkheads 402 and transverse bulkheads 406 intersect at positions located beneath pedestal support 206. In the example embodiment of FIG. 9, a single transverse bulkhead 406 is positioned beneath pedestal support 206. The intersection of longitudinal bulkheads 402 and transverse bulkheads 406 provides additional structural support and facilitates transferring the point loads from containers 204 to the bottom of hopper barge 200. In certain embodiments, additional structural support may be provided using one or more steel bars positioned in inner-bottom portion 212 underneath outer pipe 802 (e.g., on opposite sides of transverse bulkhead 406).

Figure 10:
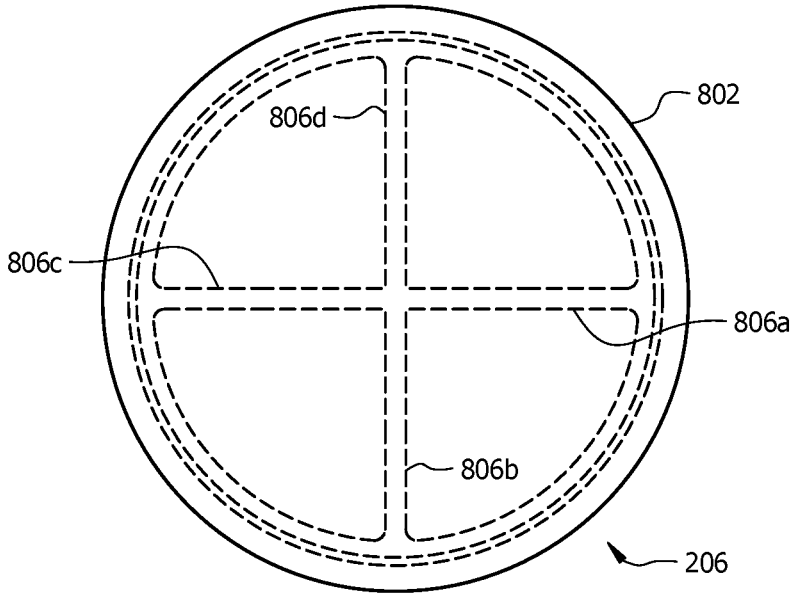
FIG. 10 illustrates a top-view of an example pedestal support, in accordance with certain embodiments.

FIG. 10 illustrates a top view of an example pedestal support, in accordance with certain embodiments. In the example embodiment of FIG. 10, pedestal support 206 is formed from an outer pipe 802. A plurality of ribs 806 is welded to outer pipe 802 to provide additional structural support for pedestal support 206. Aspects of outer pipe 802 and the plurality of ribs 806 are described above in relation to FIG. 8. The plurality of ribs 806 may cross inside of outer pipe 802.

In the example of FIG. 10, four ribs 806*a*, 806*b*, 806*c*, and 806*d* are used, effectively dividing pedestal support 206 into four quadrants. Ribs 804*a-d* may be spaced apart evenly similar to that described in relation to FIG. 8.

In the example of FIG. 10, four ribs 806 are disposed within outer pipe 802. However, one of ordinary skill in the art would recognize other embodiments in light of the present disclosure. For example, in certain embodiments, any suitable number of ribs 806 may be disposed within outer pipe 802 depending on implementation.

Outer pipe 802 may have any suitable dimension, which may vary according to implementation. In certain embodiments, outer pipe 802 may be cylinder-shaped. In certain embodiments, outer pipe 802 may have a diameter between 24-36".

The configuration of outer pipe 802 and ribs 806 illustrated in FIG. 10 provides for effective point load distribution, similar to that described in relation to FIG. 8. In certain embodiments, the configuration of pedestal support 206 illustrated in FIG. 10 may correspond to pedestal support 206 illustrated in FIG. 8 where inner pipe 804 is excluded. The configuration of pedestal support 206 illustrated in FIG. 10 may provide easier construction compared to the configuration of pedestal support 206 illustrated in FIG. 8 while providing similar structural support for containers 204 and hopper barge 200. In addition to providing easier construction and similar structural support, in forming the configuration of pedestal support 206 illustrated in FIG. 10, less material may be used compared to pedestal support 206 illustrated in FIG. 8, since inner pipe 804 is excluded.

Figure 11:
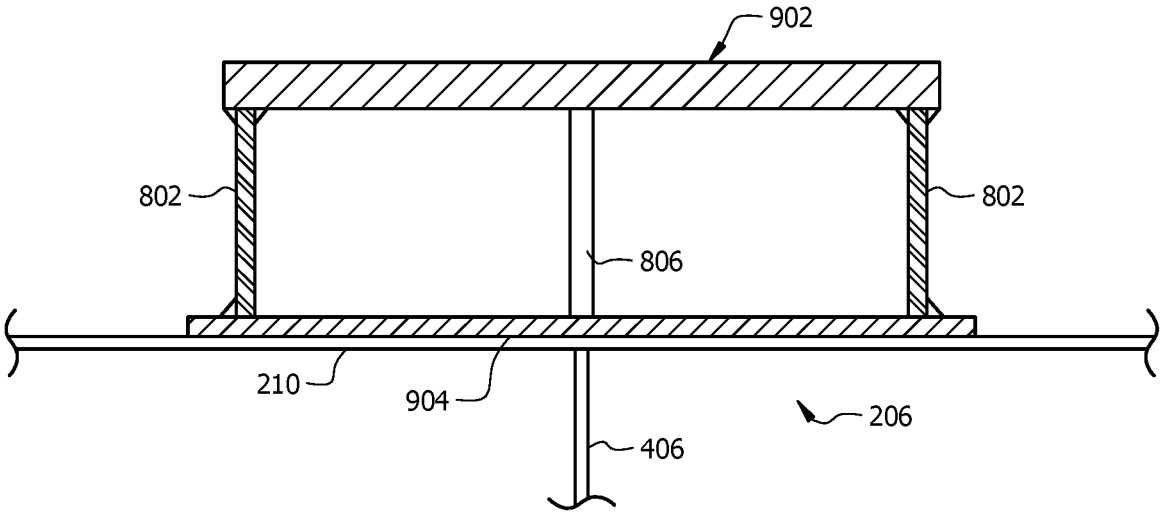
FIG. 11 illustrates a section-view of an example pedestal support, in accordance with certain embodiments.

FIG. 11 illustrates a section-view of an example pedestal support, in accordance with certain embodiments. Similar to FIG. 10 above, pedestal support 206 is formed from outer pipe 802 and ribs 806. The pedestal support 206 illustrated in FIG. 11 may be a section-view of the pedestal support 206 illustrated in FIG. 10. Outer pipe 802 and ribs 806 may have the dimensions described above in relation to FIG. 10. Additionally, in the example embodiment of FIG. 11, pedestal support 206 includes top plate 902. Top plate 902 provides a surface on which corners of containers 204 (not explicitly shown) may rest. Top plate 902 may be formed with the material, and have approximately the same dimensions as, described above in relation to FIG. 9. In certain embodiments, top plate 902 may be welded to outer pipe 802. In the example embodiment of FIG. 11, pedestal support 206 is shown resting on a bottom plate 904, which sits upon hopper compartment deck 210. In certain embodiments, bottom plate 904 may be welded to outer pipe 802.

As described above, in certain embodiments longitudinal bulkheads 402 and transverse bulkheads 406 intersect at positions located beneath pedestal support 206. In the example embodiment of FIG. 11, a single transverse bulkhead 406 is positioned beneath pedestal support 206. The intersection of longitudinal bulkheads 402 and transverse bulkheads 406 provides additional structural support and facilitates transferring the point loads from containers 204 to the bottom of hopper barge 200. In certain embodiments, additional structural support may be provided using one or more steel bars positioned in inner-bottom portion 212 underneath outer pipe 802 (e.g., on opposite sides of transverse bulkhead 406.)

Figure 12:
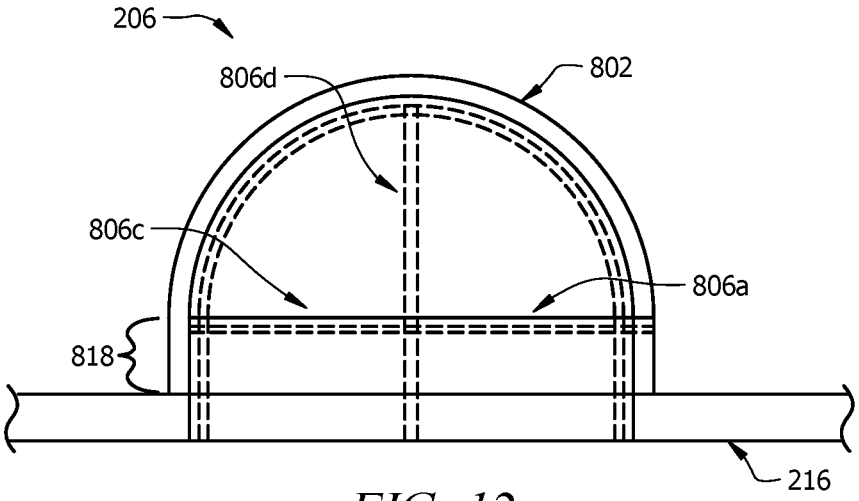
FIG. 12 illustrates a top-view of an example pedestal support, in accordance with certain embodiments.

FIG. 12 illustrates a top view of an example pedestal support, in accordance with certain embodiments. In the example of FIG. 12, pedestal support 206 is formed from an outer pipe 802. A plurality of ribs 806 is welded to outer pipe 802 to provide additional structural support for pedestal support 206. Aspects of outer pipe 802 and ribs 806 are described above in relation to FIG. 8.

In the example of FIG. 12, three ribs 806*a*, 806*c* and 806*d* are used, effectively dividing pedestal support 206 into two quadrants. Ribs 806*a*, 806*c* and 806*d* may be spaced such that the two divided quadrants of pedestal support 206 substantially have the same dimension as each other.

The configuration of pedestal support 206 illustrated in FIG. 12 may be used along the sides of hopper barge 200 where pedestal support 206 meets a hopper barge wall 216. In certain embodiments, outer pipe 802 may be substantially half cylinder-shaped, for example as illustrated in FIG. 12. Outer pipe 802 may have a diameter described above in relation to FIG. 8. For example, outer pipe 802 may have a diameter between 24-36". In certain embodiments, outer pipe 802 may include a section 808 between a substantially half cylinder-shaped section and hopper barge wall 216. Section 808 may be a continuation of the same plate that forms outer pipe 802. In certain embodiments, section 808 may have a length of 5½". In certain embodiments, section 808 may have any suitable length, for example, between 3" to 8".

In certain embodiments, the example configuration of pedestal support 206 illustrated in FIG. 12 may further include inner pipe 804. For example, the configuration of pedestal support 206 illustrated in FIG. 12 may further include substantially half cylinder-shaped inner pipe 804. In certain embodiments, inner pipe 804 may have a dimension described above in relation to FIG. 8.

Figure 13:
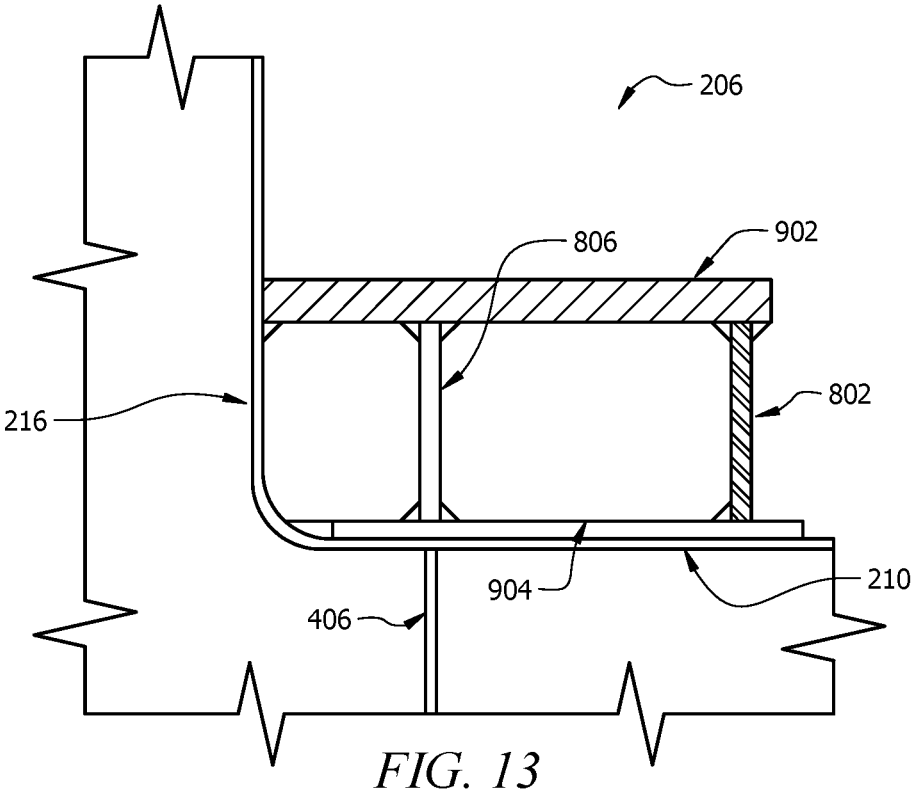
FIG. 13 illustrates a section-view of an example pedestal support, in accordance with certain embodiments.

FIG. 13 illustrates a section-view of an example pedestal support, in accordance with certain embodiments. Similar to FIG. 12 above, pedestal support 206 is formed from outer pipe 802 and ribs 806. The example pedestal support 206 illustrated in FIG. 13 may be a section-view of pedestal support 206 illustrated in FIG. 12.

Outer pipe 802 and ribs 806 may have the dimensions described above in relation to FIG. 8. Additionally, in the example embodiment of FIG. 13, pedestal support 206 includes top plate 902 similar to that described in relation to FIG. 9. In the example embodiment of FIG. 13, pedestal support 206 is shown resting on a bottom plate 904, which sits upon hopper compartment deck 210. In certain embodiments, bottom plate 904 may be welded to outer pipe 802.

In the example embodiment of FIG. 13, a single transverse bulkhead 406 is positioned beneath pedestal support 206. The transverse bulkhead 406 may intersect with a longitudinal bulkhead 402 (not explicitly shown) beneath pedestal support 206, as described above in relation to FIGS. 9 and 11. Aspects of the intersection of transverse bulkhead 406 and longitudinal bulkhead 402 are described above in relation to FIGS. 9 and 11.

Figure 14:
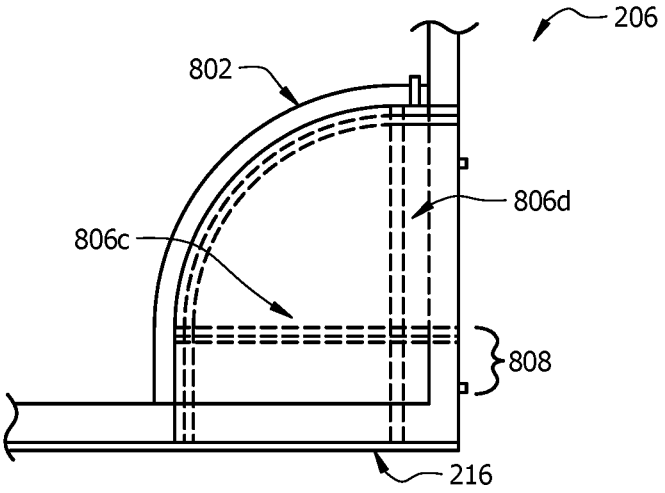
FIG. 14 illustrates a top-view of an example pedestal support, in accordance with certain embodiments.

FIG. 14 illustrates a top view of an example pedestal support, in accordance with certain embodiments. In the example of FIG. 14, pedestal support 206 is formed from an outer pipe 802. A plurality of ribs 806 is welded to outer pipe 802 to provide additional structural support for pedestal support 206. Aspects of outer pipe 802 and ribs 806 are described above in relation to FIG. 8.

In the example of FIG. 14, two ribs 806*c* and 806*d* are used to provide structural support for pedestal support 206. The configuration of pedestal support 206 illustrated in FIG. 14 may be advantageously used in corners of hopper barge 200 where pedestal support 206 meets two adjacent barge walls 216. In certain embodiments, outer pipe 802 may be substantially quarter cylinder-shaped. Outer pipe 802 may have a dimension described above in relation to FIGS. 8 and 12. In certain embodiments, outer pipe 802 may include a section 808 between a substantially half cylinder-shaped section and hopper barge walls 216. Aspects of section 800 are described in relation to FIG. 12.

In certain embodiments, the example configuration of pedestal support 206 illustrated in FIG. 14 may further include inner pipe 804. For example, the configuration of pedestal support 206 illustrated in FIG. 14 may further include substantially quarter cylinder-shaped inner pipe 804. In certain embodiments, inner pipe 804 may have a dimension described above in relation to FIG. 8.

Figure 15:
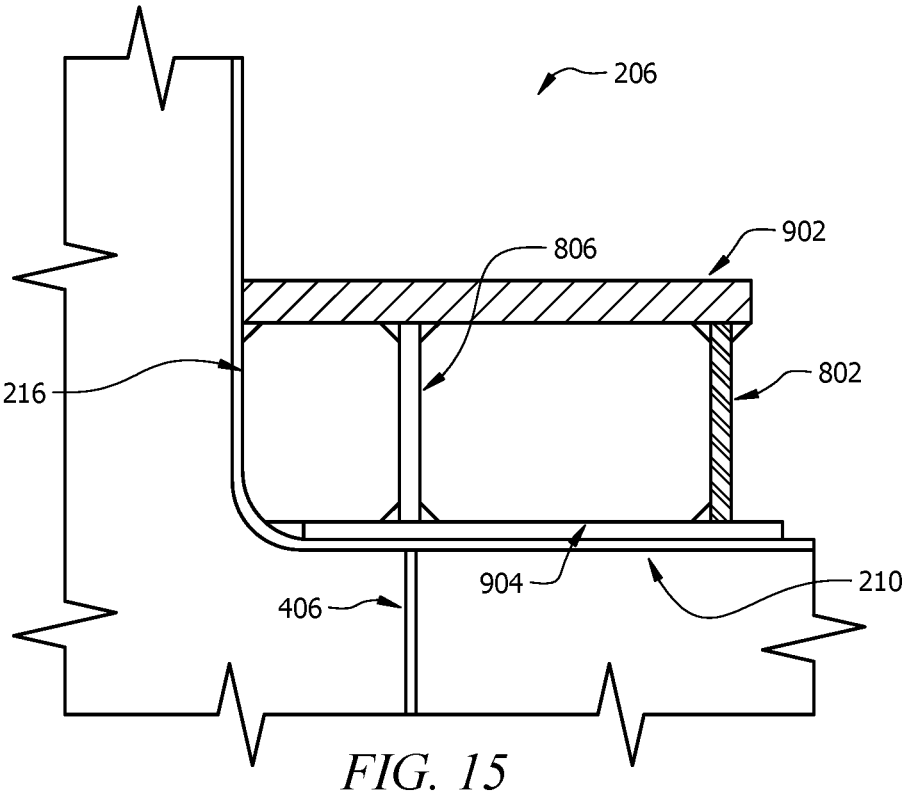
FIG. 15 illustrates a section-view of an example pedestal support, in accordance with certain embodiments.

FIG. 15 illustrates a section-view of an example pedestal support, in accordance with certain embodiments. Similar to FIG. 14 above, pedestal support 206 is formed from outer pipe 802 and ribs 806. The example pedestal support 206 illustrated in FIG. 15 may be a section-view of pedestal support 206 illustrated in FIG. 14.

Outer pipe 802 and ribs 806 may have the dimensions described above in relation to FIG. 8. Additionally, in the example embodiment of FIG. 15, pedestal support 206 includes top plate 902 similar to that described in relation to FIG. 9. In the example embodiment of FIG. 15, pedestal support 206 is shown resting on a bottom plate 904, which sits upon hopper compartment deck 210. In certain embodiments, bottom plate 904 may be welded to outer pipe 802.

In the example embodiment of FIG. 15, a single transverse bulkhead 406 is positioned beneath pedestal support 206. The transverse bulkhead 406 may intersect with a longitudinal bulkhead 402 (not explicitly shown) beneath pedestal support 206, as described above in relation to FIGS. 9 and 11. Aspects of the intersection transverse bulkhead 406 and longitudinal bulkhead 402 are described above in relation to FIGS. 9 and 11.

In certain embodiments, pedestal support 206 may be constructed or formed with a one-piece cast iron frame.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

EXAMPLE EMBODIMENTS

1. A hopper barge, comprising:
   an inner-bottom portion having arranged therein a plurality of longitudinal bulkheads and a plurality of transverse bulkheads, the transverse bulkheads running perpendicular to the longitudinal bulkheads.
2. The hopper barge of embodiment 1, wherein the hopper barge is approximately 70 feet wide.
3. A pedestal support, comprising:
   an outer pipe;
   an inner pipe disposed within the outer pipe; and
   a plurality of rib plates affixed to the outer pipe and the inner pipe.
4. The pedestal support of embodiment 3, further comprising a top plate.
5. The pedestal support of any of embodiments 3-4, further comprising a bottom plate.
6. The pedestal support of any of embodiments 3-5, wherein the plurality of rib plates are affixed to the outer pipe and the inner pipe by welding.

7. The pedestal support of any of embodiments 3-6, wherein the outer pipe has a diameter of 30 inches.

8. The pedestal support of any of embodiments 3-7, wherein the inner pipe has a diameter of 16 inches.

9. A hopper barge, comprising:

at least one longitudinal bulkhead;

at least one transverse bulkhead; and at least one pedestal support, wherein the at least one longitudinal bulkhead and the at least one transverse bulkhead intersect at a position beneath the at least one pedestal support.

10. The hopper barge of embodiment 9, wherein the hopper barge is approximately 70 feet wide.

11. A hopper barge, comprising:

a hopper compartment for carrying a plurality of containers, the hopper compartment comprising a hopper compartment deck;

an inner-bottom portion defined in part by the hopper compartment deck and a bottom portion of the hopper barge;

a plurality of longitudinal bulkheads arranged in parallel within the inner-bottom portion of the hopper barge;

a plurality of transverse bulkheads arranged in parallel within the inner-bottom portion of the hopper barge, the plurality of transverse bulkheads running perpendicular to the plurality of longitudinal bulkheads; and a plurality of pedestal supports affixed to the hopper compartment deck, wherein at least one of the plurality of longitudinal bulkheads intersects at least one of the plurality of transverse bulkheads at a position beneath at least one of the plurality of pedestal supports.

12. The hopper barge of embodiment 10, wherein the hopper barge is approximately 70 feet wide.

13. The hopper barge of any of embodiments 11-12, wherein the at least one of the plurality of pedestal supports comprises:

an outer pipe;

an inner pipe disposed within the outer pipe; and a plurality of rib plates affixed to the outer pipe and the inner pipe.

14. The hopper barge of any of embodiments 11-13, wherein the at least one of the plurality of pedestal supports comprises a top plate.

15. The hopper barge of any of embodiments 11-14, wherein the at least one of the plurality of pedestal supports comprises a bottom plate.

16. The hopper barge of any of embodiments 13-15, wherein the plurality of rib plates are affixed to the outer pipe and the inner pipe by welding.

17. The hopper barge of any of embodiments 13-16, wherein the outer pipe has a diameter of 30 inches.

18. The hopper barge of any of embodiments 13-17, wherein the inner pipe has a diameter of 16 inches.

The invention claimed is:

1. A hopper barge, comprising:

a hopper compartment for carrying a plurality of containers, the hopper compartment comprising a hopper compartment deck;

an inner-bottom portion defined in part by the hopper compartment deck and a bottom portion of the hopper barge;

a plurality of longitudinal bulkheads arranged in parallel within the inner-bottom portion of the hopper barge;

a plurality of transverse bulkheads arranged in parallel within the inner-bottom portion of the hopper barge, the plurality of transverse bulkheads running perpendicular to the plurality of longitudinal bulkheads; and a plurality of pedestal supports affixed to the hopper compartment deck, wherein at least one of the plurality of longitudinal bulkheads intersects at least one of the plurality of transverse bulkheads at a position beneath at least one of the plurality of pedestal supports.

2. The hopper barge of claim 1, wherein the at least one of the plurality of pedestal supports comprises at least one of a top plate and a bottom plate.

3. The hopper barge of claim 1, wherein the at least one of the plurality of pedestal supports comprises:

an outer pipe; and a plurality of rib plates affixed to the outer pipe.

4. The hopper barge of claim 3, wherein the plurality of rib plates are affixed to the outer pipe by welding.

5. The hopper barge of claim 3, wherein the outer pipe has a diameter of 30 inches.

6. The hopper barge of claim 3, wherein the outer pipe is cylinder-shaped.

7. The hopper barge of claim 3, wherein the outer pipe is half cylinder-shaped.

8. The hopper barge of claim 3, wherein the outer pipe is quarter cylinder-shaped.

9. The hopper barge of claim 3, wherein the at least one of the plurality of pedestal supports further comprises an inner pipe disposed within the outer pipe.

10. The hopper barge of claim 9, wherein:

the inner pipe has a diameter of 16 inches; and the plurality of rib plates are affixed to the inner pipe by welding.

* * * * *